US006126484A

United States Patent [19]

Klein et al.

[11] Patent Number: 6,126,484

[45] Date of Patent: Oct. 3, 2000

[54] ELECTRICAL CONNECTOR WITH MOLDED LATCH STOP

[75] Inventors: David Allen Klein, Kernersville; Billy Hayes Simpson, Yadkinville, both of N.C.

[73] Assignee: The Whitaker Corporation, Wilmington, Del.

[21] Appl. No.: 09/431,767

[22] Filed: Nov. 1, 1999

[51] Int. Cl.[7] ..... H01R 13/422

[52] U.S. Cl. ..... 439/595; 439/852; 439/157; 439/597

[58] Field of Search ..... 439/595, 852, 439/744, 157, 597, 598, 599, 603

[56] References Cited

U.S. PATENT DOCUMENTS

| | | | |
|---|---|---|---|
| 4,891,021 | 1/1990 | Hayes et al. | 439/599 |
| 4,984,998 | 1/1991 | Duncan et al. | 439/352 |
| 4,986,766 | 1/1991 | Leonard et al. | 439/352 |
| 5,242,317 | 9/1993 | Watanabe | 439/595 |
| 5,322,448 | 6/1994 | Hahn | 439/157 |
| 5,322,457 | 6/1994 | Tsuji et al. | 439/595 |
| 5,518,334 | 5/1996 | Yagi et al. | 403/291 |
| 5,738,543 | 4/1998 | Rollins et al. | 439/595 |
| 5,743,761 | 4/1998 | Kawase | 439/595 |
| 5,882,212 | 3/1999 | McHugh et al. | 439/74 |
| 5,885,105 | 3/1999 | Takagishi et al. | 439/595 |
| 6,045,404 | 4/2000 | Myer | 439/595 |

*Primary Examiner*—Paula Bradley
*Assistant Examiner*—Truc Nguyen

[57] ABSTRACT

An electrical connector 10 includes a housing 12 with a plurality of terminals 60 disposed in housing cavities 20. A molded deflectable latch 40 extends from the housing 12 into each cavity 20. The latch 40 engages a terminal 60 positioned within the corresponding cavity 20. The latch 40 deflects to permit insertion of the terminal into the corresponding cavity 20. Each cavity 20 is formed by at least one interior wall 30. Each molded latch 40 deflects relative to an adjacent interior wall 30 and has a finger 50 protruding from the latch 40 toward the adjacent interior wall 30. Each interior wall 30 has an outer shoulder 32 projecting toward an adjacent latch 40 and positioned relative to the finger 50 to prevent excessive deflection of the molded latch 40. The finger 50 is positioned relative to the adjacent interior wall 30 to prevent the latch 40 from lateral movement toward the adjacent interior wall 30 as the latch 40 is deflected.

20 Claims, 7 Drawing Sheets

ELECTRICAL CONNECTOR WITH MOLDED LATCH STOP

BACKGROUND OF THE INVENTION

1. Field of the Invention

This invention is related to electrical connectors and especially to electrical connectors that have molded latches forming a part of a molded connector housing. These molded latches serve as primary retention members to secure electrical terminals or contacts in the housing. This invention is also related to electrical connector assemblies that uses a mechanical assist, such as a lever, to overcome large mating forces between connectors having a large number of mating terminals or contracts mounted in two mating connectors.

2. Description of the Prior Art

Crimp snap terminals are commonly used in mating electrical connectors that employ a large number of mating terminals. These terminals are first crimped to wires that may be part of an electrical harness, and the terminals are then inserted into cavities in a molded connector housing. Many of these conventional crimp snap terminals have metal tangs or lances protruding from the terminal. These tangs or lances are deflected as the terminals are inserted into the housing cavities, and the lances then snap back to their normal position engaging a surface on the connector to secure the terminals in the housing cavities after they have been completely inserted. In many applications, such as automotive and motor vehicle assemblies, these protruding metal lances pose problems. The protruding lances can become snagged on the wires causing difficulties during assembly, or the lances can be damaged so that they do not adequately retain the terminal in the housing. When two connectors are mated, a mating force between terminals can then dislodge improperly seated terminals.

An alternative to the use of metal lances is to mold resilient plastic latches as part of the molded electrical connector housing. These molded latches are typically located on one side of the housing cavities in which the terminals are positioned. When the terminals or contacts are inserted, each plastic latch is separately deflected outwardly to permit the terminal to move to its fully seated position. When the terminal is fully seated, the plastic latch can return to its neutral position where it will engage a shoulder or and edge of the terminal to retain the terminal during mating. In many of the connectors of this type, a gap is formed between the plastic latches and an adjacent housing wall, typically an outer housing wall. The adjacent wall then serves as a back-up preventing excessive deflection of the molded latch, either during terminal insertion or removal. Often a separate terminal position assurance member is then inserted into the gap between the wall and the molded latch. This terminal position assurance member can only be inserted into this gap if the terminal has been fully inserted allowing the molded latch to return to its normal position. However, the need to provide a back-up wall and a gap to provide space both for latch deflection and for insertion of a terminal position assurance member results is a larger connector by increasing the height of the housing.

Some prior art electrical connectors have eliminated the outer back up wall from the housing and have placed the molded latches on an external surface of the connector housing. Representative examples of this approach are shown in U.S. Pat. Nos. 4,891,021 and in 4,984,998. However, to prevent excessive deflection of the molded latches and overstressing of the plastic, these prior art connectors have still employed overstress projections, which limit outward deflection of the molded latches. These overstress projections can also add height to the connector housing unless they do not extend beyond connector latches or other structures located on the exterior of the housing. However, when the sides of the connector are otherwise free of projecting structures, these overstress projections increase the size and height of the connector. The size of the opening or pocket in which the connector is to be located is thereby affected, or the spacing on which the connectors are to be mounted is adversely affected.

Another prior art approach that has been employed to back-up molded latches located on the exterior of the housing is to use an outer shell that fits over the external latches and is usually inserted over the mating end of the housing or from the side. This shell can protect the molded latches when the connector is in use, but they can only be assembled after the terminals have been fully inserted. The shells therefore serve as a terminal position assurance member, but they do not function as a back-up or anti-overstress member to protect the molded latches during terminal insertion or removal. These outer shells also add another layer with a resultant increase in the height and size of the electrical connector assembly.

One application in which the height or lateral dimension of an electrical connector is important is when the connector must be mated in a shroud or shield, especially one having a standard or predetermined size. For example, U.S. Pat. No. 5,322,448 discloses an electrical connector having a lever actuated mechanism for mating a connector containing receptacle contacts to a pin header. That connector includes an outer shroud or shield to which a lever mechanism is attached. An electrical connector is fitted into a pocket in the shroud and the lever engages a rack on a mating pin header to simplify mating two multi-position electrical connectors. Although not included in that disclosure, the electrical connector, with which that assembly is used, employs contacts having metal lances to secure the contact in the connector housing cavities. However, as previously discussed, that configuration requires less space than a conventional connector employing molded plastic contact retention latches.

SUMMARY OF THE INVENTION

One of the objects of this invention is to provide an electrical connector that can fit into a shroud of a lever actuated connector assembly that is conventionally employed with terminals having metal contact retention lances. This invention employs molded contact retention lances in a shroud or shield that is substantially the same size as the prior art shroud.

This invention also provides for overstress prevention by limiting the deflection of the plastic latch without including structure that increases the height or lateral dimension of the connector housing.

Another object successfully achieved by this invention is to include anti-overstress protection for molded latches in a connector housing that can be efficiently molded.

These and other objects are achieved by an electrical connector that includes a housing with a plurality of terminals disposed in housing cavities. A molded deflectable latch extends from the housing into each cavity. The latch engages a terminal positioned within the corresponding cavity. The latch deflects to permit insertion of the terminal into the corresponding cavity. Each cavity is formed by at least one interior wall. Each molded latch deflects relative to an adjacent interior wall and has a finger protruding from the latch toward the adjacent interior wall. Each interior wall has an outer shoulder projecting toward an adjacent latch and positioned relative to the finger to prevent excessive deflection of the molded latch. The finger is positioned relative to the adjacent interior wall to prevent the latch from lateral movement toward the adjacent interior wall as the latch is deflected

DETAILED DESCRIPTION OF THE PREFERRED EMBODIMENT

Figure 1:
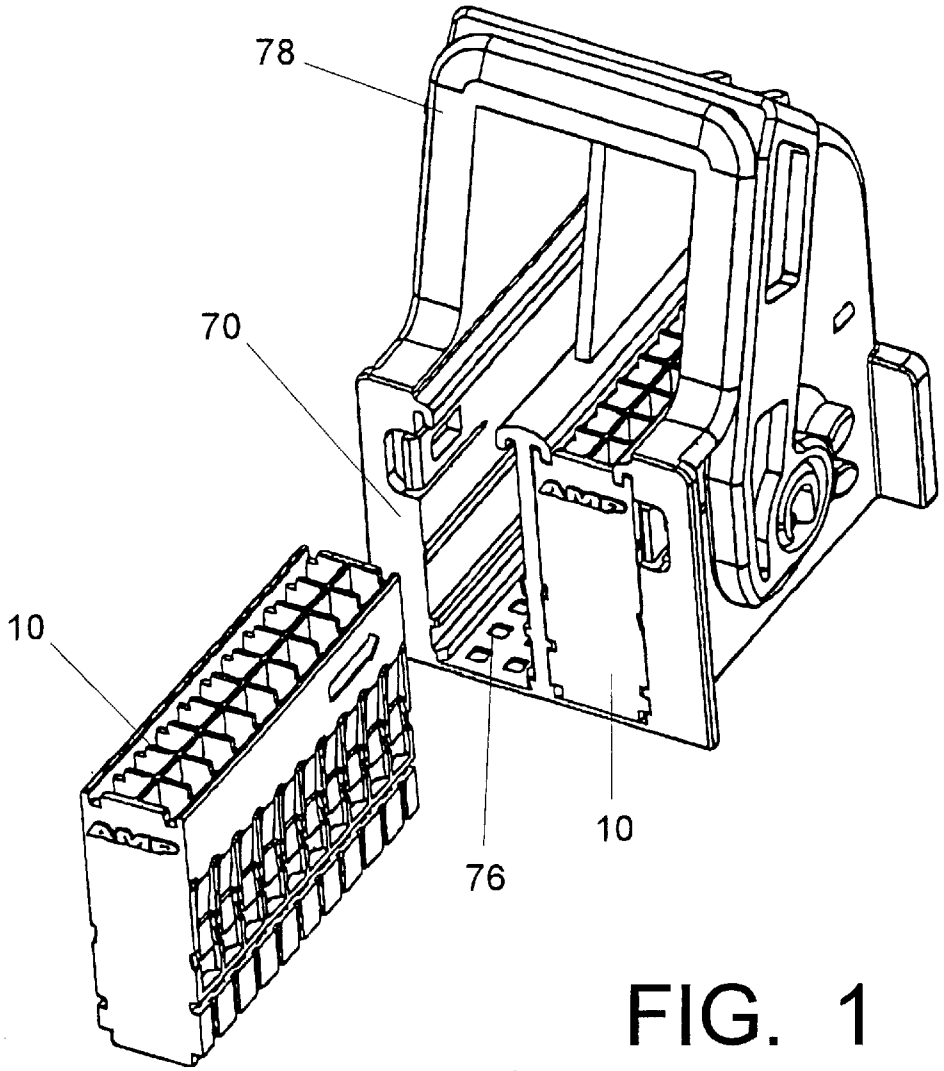
FIG. 1 is an exploded three dimensional drawing of a connector assembly including two electrical connectors with one of the connectors being positioned in a shield or shroud cavity and the other connector shown in alignment with a second cavity in the lever actuated shield.

An electrical connector assembly as shown in FIG. 1 includes two electrical connectors 10 that can be inserted into cavities 76 in a lever actuating shield or shroud 70. The shield or shroud 70 includes a lever 78 that can be used to provide a mechanical advantage to mate the two multicontact electrical connectors 10 to a mating electrical connector, such as a standard pin header, not shown. The connectors 10 are inserted endwise into closely fitting shield cavities 76 before the lever 78 is rotated to mate all of the contacts or terminals in the two connectors or carriers to the mating pins. The manner in which the lever engages the mating connector or header is the same as that employed on other lever actuated electrical connectors of this type and need not be discussed in greater detail because the lever actuation does not form a part of the invention disclosed herein. U.S. Pat. No. 5,322,448, incorporated herein by reference discloses the manner in which one such lever actuated electrical connector is employed. U.S. patent application Ser. No. 09/411,511 filed on Oct. 1, 1999 (Attorney's Docket No. 17479), also incorporated herein by reference, shows a similar lever actuated connector. The preferred embodiment of the invention shown herein employs two electrical connectors 10 positioned in two cavities of a shield or shroud 70, but an alternate embodiment in which one connector is mounted in one lever actuated connector, such as that shown in the previously mentioned U.S. patent application Ser. No. 09/411,511 filed on Oct. 1, 1999, can also be used with the invention disclosed herein.

The electrical connector 10 includes a molded housing 12 having housing cavities 20 in which terminals 60 are positioned. The preferred embodiment of connector or carrier 10 has two rows of housing cavities 20 which extend between a mating face 16 and a rear face 18. Two outer side faces 14, extending between the mating face 16 and the rear face 18, include exposed molded latches 40. One latch 40 is located on the outer side of each housing cavity 20. The latch 40 is located between a front or mating cavity end 22 and a rear cavity end 24. One terminal 60 can be inserted through the rear cavity end 24, and when the terminal 60 is fully inserted into the corresponding cavity 20, the molded latch 50 engages the terminal 60 and prevents extraction of the terminal 60 from the rear of the housing 12. During insertion of the terminals 60, the molded cantilever latch 40 in each cavity is deflected outward to permit movement of the associated terminal 60 past the latch 40. Since the opening at the front of each cavity 20 is smaller than the terminal 60, forward movement of the terminal 60 is limited, and when the terminal 60 is fully inserted, the cantilever latch 40 will snap back into its original position behind the terminal 60 to prevent rearward movement. The molded cantilever latch 40 thus serves as the primary latch to secure the terminal 60 in the cavity 20.

The cavities 20 are formed by a series of interior walls 30 that extend at right angles relative to the outer side faces 14 of the housing 12. These interior walls 30 also extend at right angles relative to a central wall that forms the inside surface of the cavities 20 in both oppositely facing rows. Two exterior walls 26 and 28 are separated by the molded cantilever latching beams 40 that are located on the exterior of the cavities 20. The cantilever beams 40 are integrally molded extensions of rear exterior walls 26. Front exterior walls 28 extend between distal ends 44 of the latches 40 and the mating face 16 of the connector housing 12.

Interior walls 30 extend beside and between latches 40 between the latch base end 42 and the latch distal end 44. Each interior wall 30 has an outer stop shoulder 32 located at the top of the interior wall adjacent to the free end of the latch 40. The outer stop shoulder extends laterally toward the latch 40 from the adjacent surface of the wall 40. Each wall 30 has a single outer stop shoulder 32 that extends partially over only one of the adjacent cavities 30 separated by each wall 30. All of the outer stop shoulders 32 thus extend in the same direction, and one stop shoulder 32 overlaps a portion of the exterior face of each cavity 30.

An inner stop shoulder 34 is located on each interior wall 30 below and in opposition to the associated outer stop shoulder 32. A groove 36 extends between the two stop shoulders 32 and 34 and this groove forms a section of walls 30 that has a thickness that is less than the portion of the wall extending below the inner stop shoulder. Grooves 36 and shoulders 32 and 34 are all located adjacent to an associated latch 40 and each is located closer to the distal or free end 44 than to the integral latch base end 42.

Figure 2:
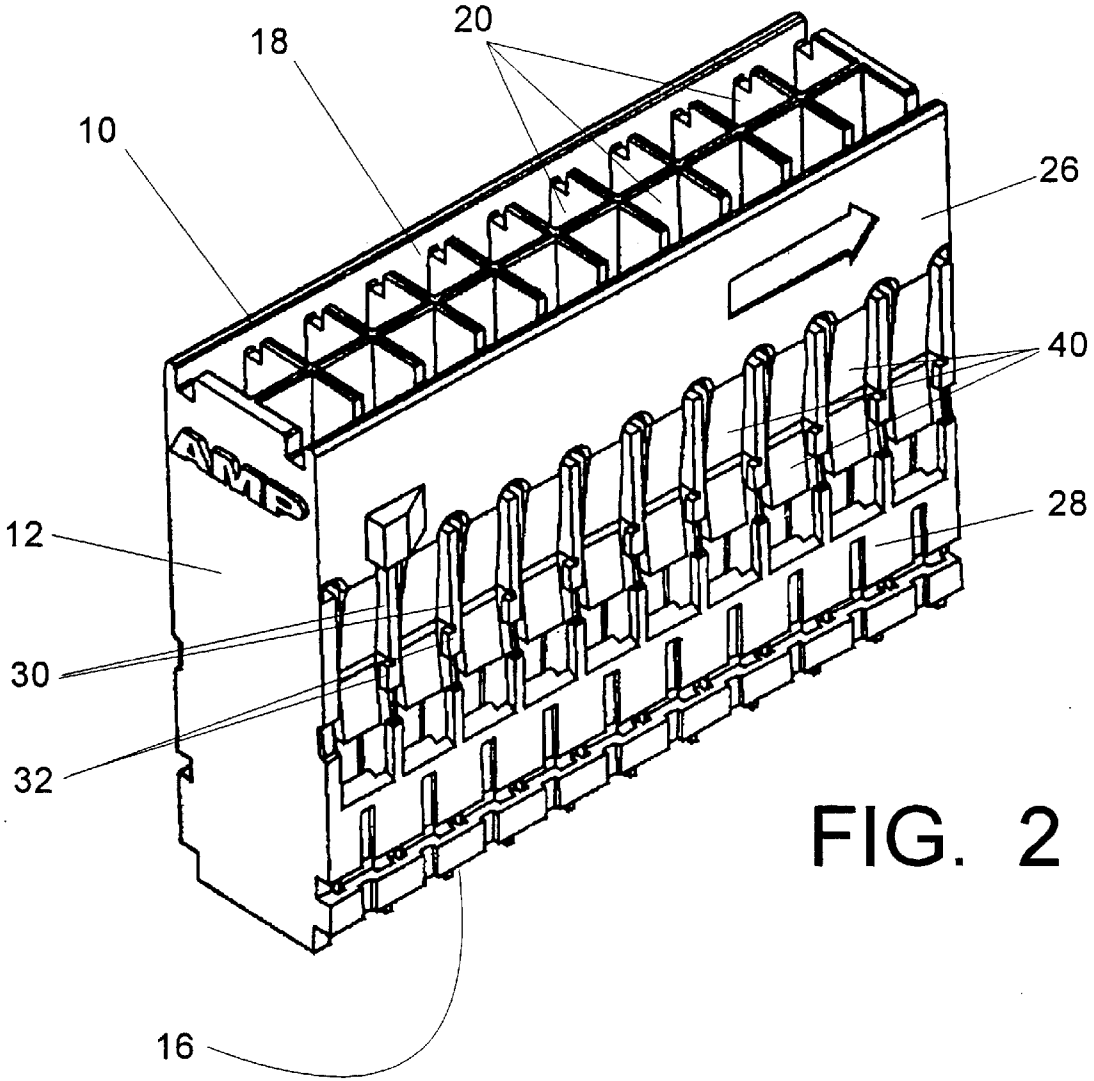
FIG. 2 is a three dimensional view of one of the electrical connectors showing more detail of one side of the connector housing.
Figure 4:
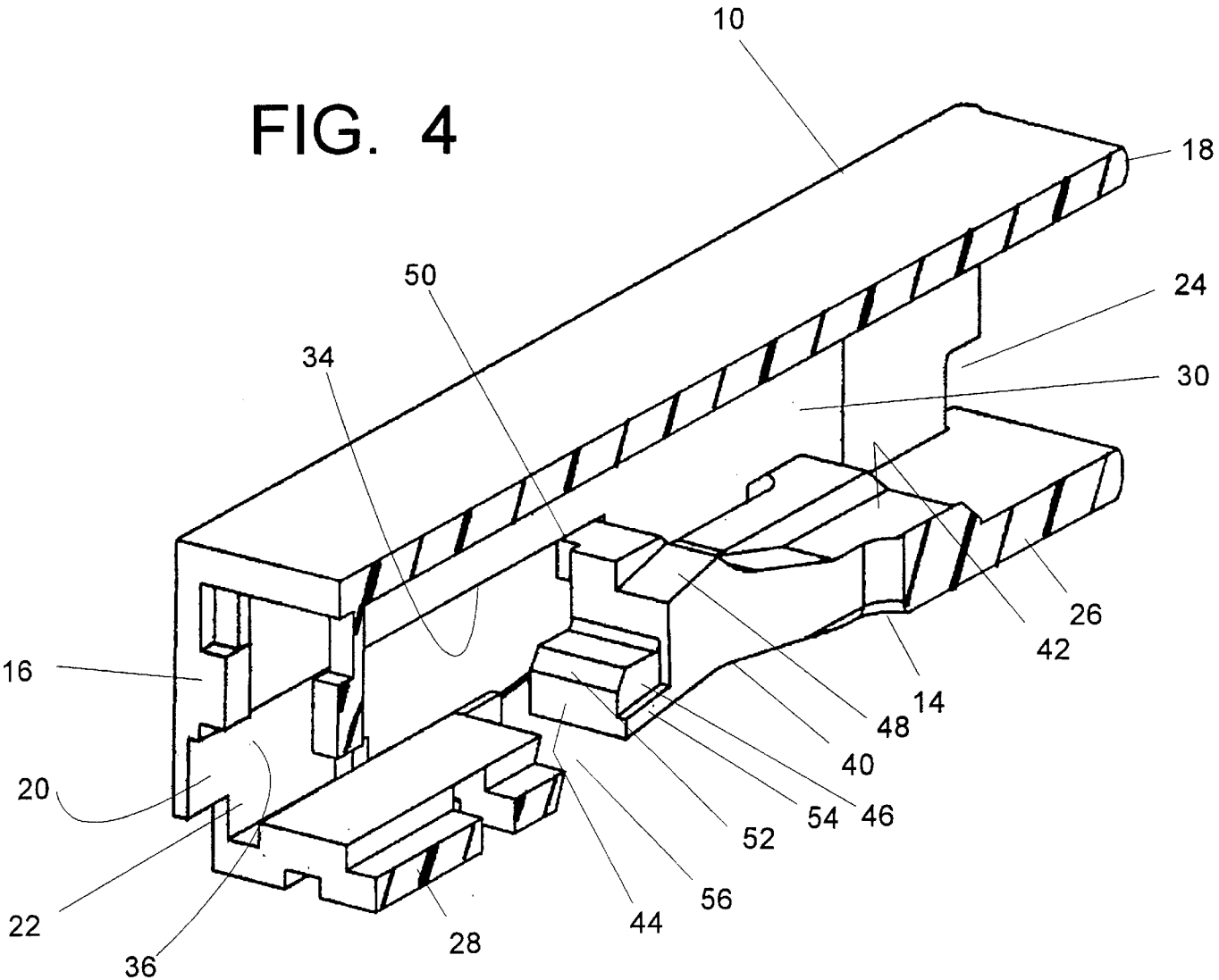
FIG. 4 is another section view showing a single housing cavity and the molded deflectable cantilever beam terminal latch which secures a terminal in the housing cavity. The same housing cavity is shown in FIGS. 3 and 4, but the views are from opposite directions for purposes of illustration.
Figure 5:
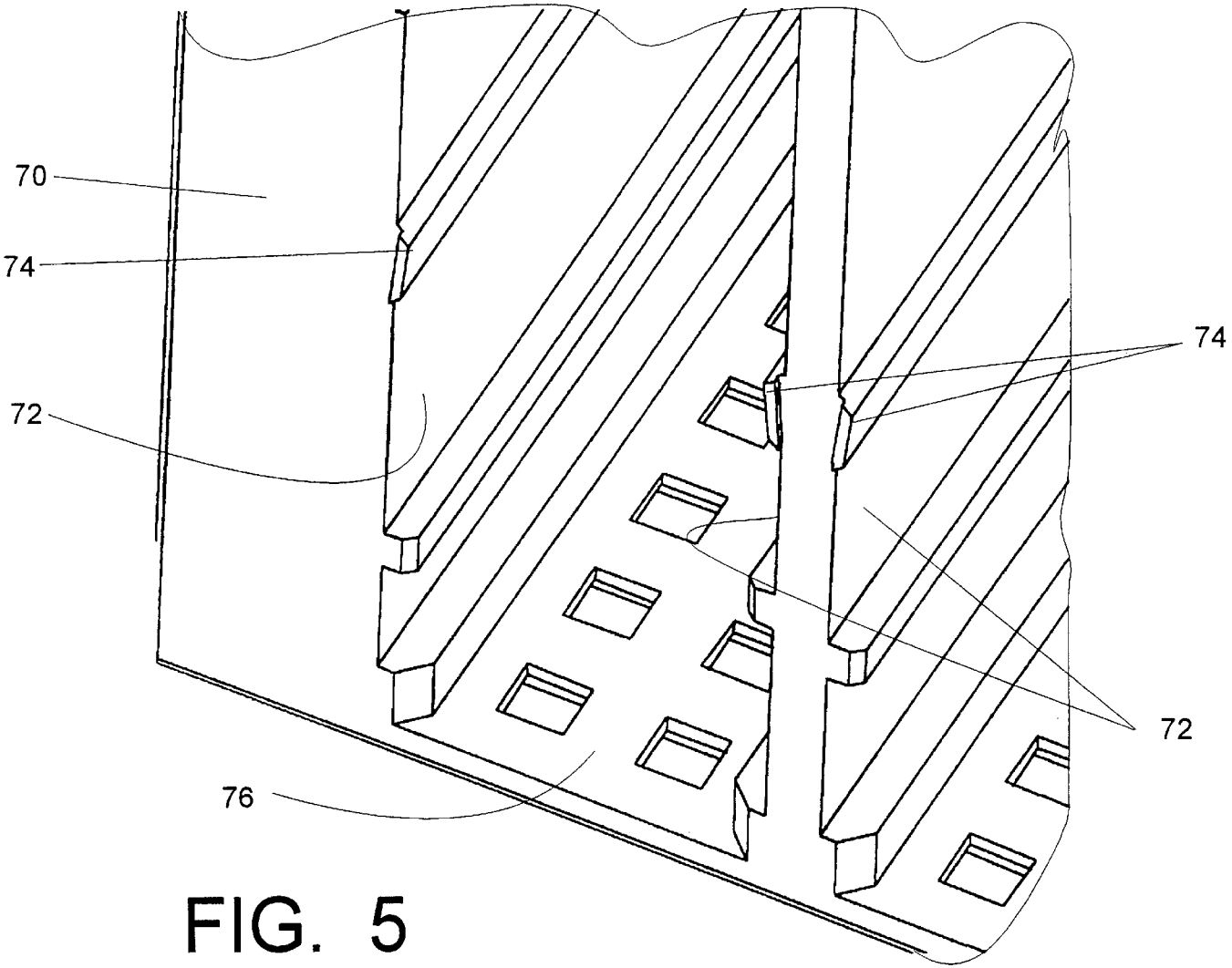
FIG. 5 is an enlarged partial view of the front of the shield or shroud shown in FIG. 1, with the shield cavities in which the connectors are inserted being shown in greater detail.

Each molded cantilever latch 40 extends from the rear exterior side wall 26 toward the mating housing face 16 and the mating end 22 of the cavity 20. Each latch base end 42 forms a continuation of the exterior side wall 26 so that the latches 40 are integrally molded with the one piece molded housing 12. The exterior surface of the latch 40 is exposed on the front of the rear side wall 26 and initially slopes inward. As best shown in FIG. 4, the portion of the latch outer surface closer to the distal or free end 44 slopes outward. The latch 40 is exposed between the rear side wall 26 and the front side wall 28, and these three surfaces form the exterior of both sides of the dual row housing 12 as shown in FIGS. 1 and 2.

A gap or latch access opening 56 is formed between the latch distal end 44 and the front exterior wall 28. This access opening permits insertion of a small tool to engage a latch deflection extension 52 adjacent the distal end 44. When the tool engages the extension 52, the latch 40 can be pried out of engagement with a terminal 60 in its housing cavity 20 so that the terminal 60 can be removed through the rear cavity end 24.

Each latch 40 includes a latch protrusion or projection 48 on the inner latch surface. This latch protrusion 48 is configured to engage a fully inserted terminal 60 to secure the terminal 60 against withdrawal from the corresponding cavity 20. The latching protrusion has a sloping rear surface that is engaged by the front end of a terminal 60 during insertion of the terminal 60 into its cavity 20. The cantilever beam latch 40 is cammed outwardly by continued insertion of the terminal 70 so that the mating contact section 62 shown in FIG. 6 can pass the latching protrusion 48. After the terminal 60 has been fully inserted, the latching protrusion 48 clears the rear edge 66 of the terminal contact section 62 and abuts this edge 66 to prevent withdrawal of the terminal 60 form its fully inserted position. However, the terminal 60 must be fully inserted to permit the latch 40 to return to its normal position shown in FIGS. 3 and 4. When the terminal contact section 62 engages the latching protrusion 48 a portion of the exterior of the latch 40, including the distal or free end 44 projects outwardly beyond the exterior surface of the rear side wall 26 and the front side wall 28. In this position with the latch 40 deflected, the connector 10 cannot be inserted into the shield cavity 76, because the latch extension 52 abuts a ridge on an adjacent shield cavity wall 72. A pocket 46 is formed on the inside of the latch ridge 54. When the latch 40 is outwardly deflected position, the shield cavity wall ridge 74 with fit within the pocket 46, and it will not be possible to round off the edge of the latch or force the latch inwardly to crush a partially inserted terminal 60. These abutting surfaces thus function as terminal position assurance means preventing insertion of the connector 10 into the shield 70 if only one of the terminals 70 is only partially inserted into its housing cavity 20.

Figure 6:
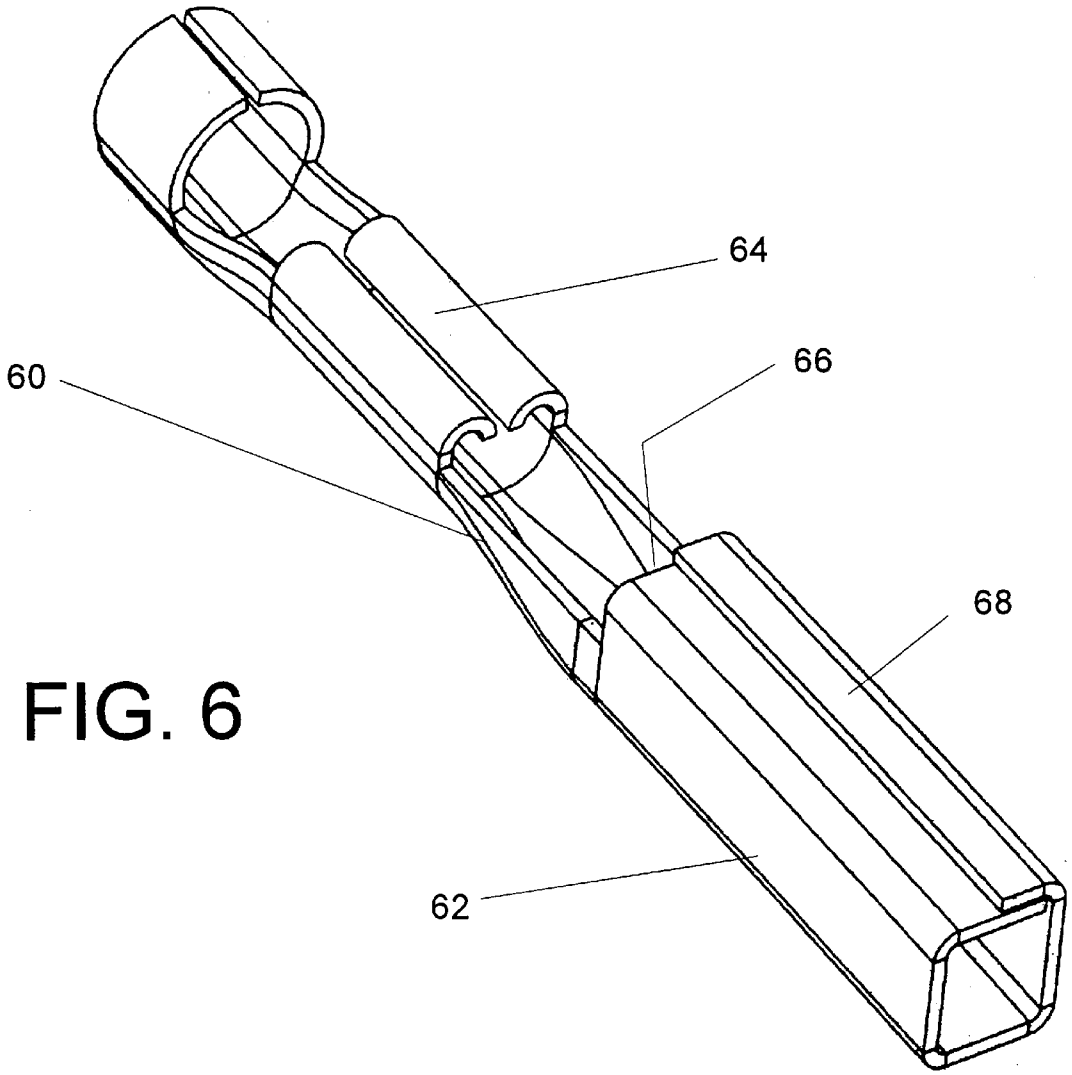
FIG. 6 is a three dimensional view of the exterior envelope of a terminal that would be inserted into a housing cavity of the connector shown in FIGS. 1–4.

The latching protrusion 48 also has a sloping section facing forward that has a width that is approximately one half the width of the latching protrusion. A square section is located beside the sloping section. As seen in FIG. 6, the terminal 60 has an overlapping section 68 in the contact section so that the top of the contact section 62 is uneven. When the contact 60 is properly inserted into the cavity 20, the square portion on the front of the latching protrusion 48 engages the edge of the overlapping terminal section 68, and the sloping portion of the latching protrusion engages the lower portion of the edge 66. The maximum height of the sloping portion of the latch protrusion is however the same as the height of the square portion. Since this sloping or ramping portion will engage the overlapping contact section 68 on the terminal, the maximum deflection of the latch, during insertion of a terminal 60 will be caused by engagement of the top of this sloping latch section and the overlapping terminal portion 68. Thus the latch 40 will deflect more than if the sloping section of the latch protrusion 48 were not present.

Figure 3:
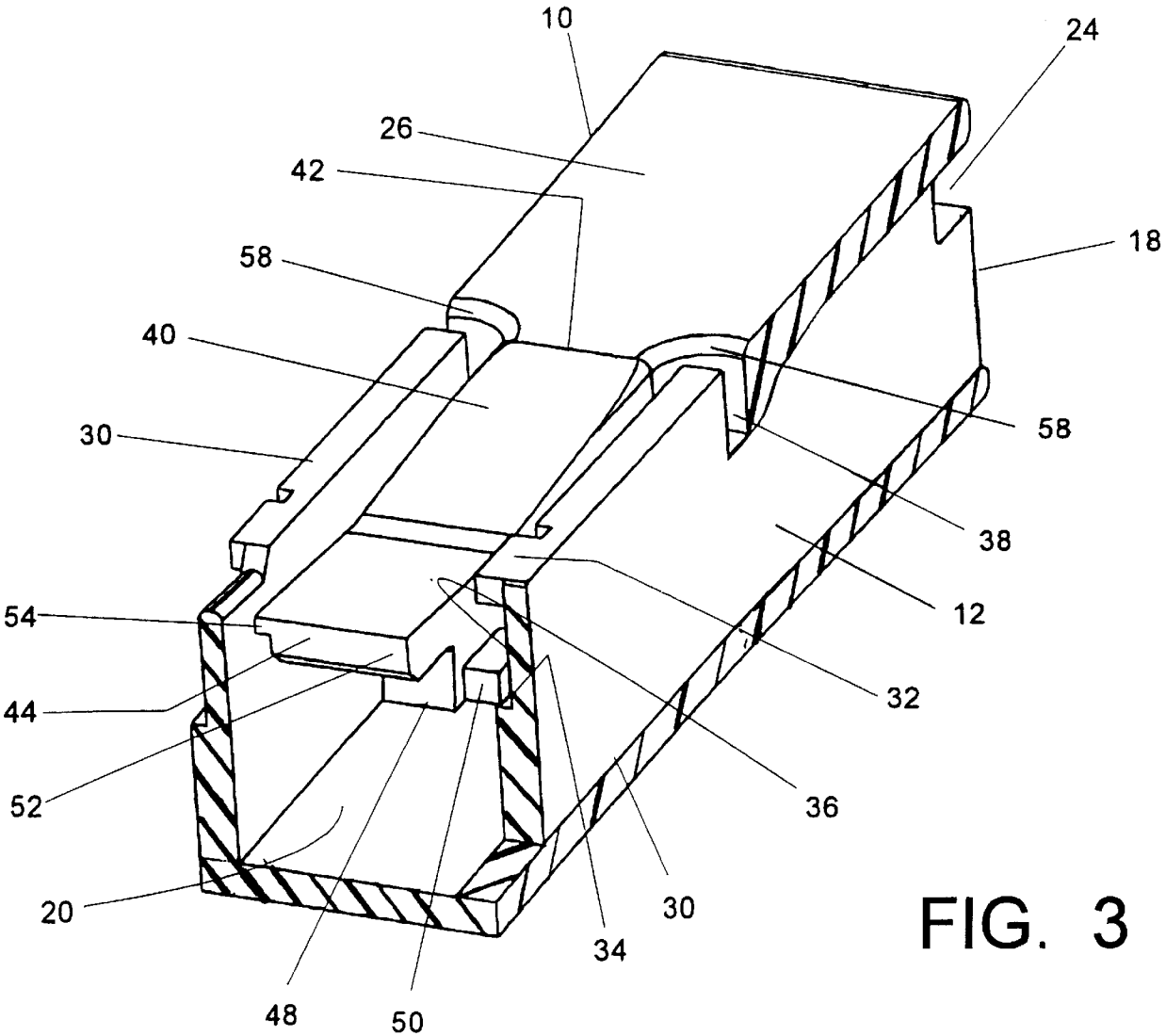
FIG. 3 is a section view showing a portion of a single housing cavity in the electrical connector housing shown in FIGS. 1 and 2 with the portion of the housing cavity in the vicinity of a molded cantilever terminal latch shown for purposes of illustration
Figure 7:
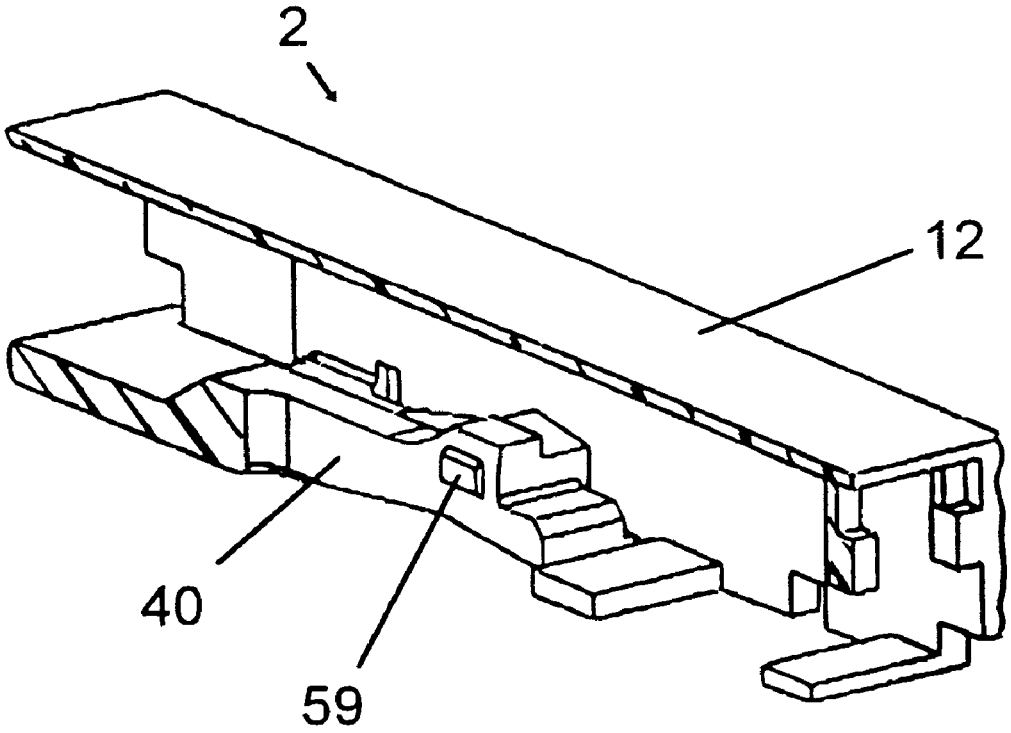
FIG. 7 is a view of an alternate embodiment of this invention with a bump on one side of the latch to prevent excessive latch lean due to side load.

The latching protrusion 48 also has a finger 50 that protrudes laterally relative to the latch 40 and is located at he top of the square portion of the latching protrusion 48, as best shown in FIGS. 3 and 4. The upper stop shoulder 32 and the inner stop shoulder 34 on the interior wall 30 both overlap the finger 50, and movement of the finger 50 in the groove 36 is limited by shoulders 32 and 34. When the latch 40 is deflected outward, either during insertion of a terminal 60 into a cavity 20 or when an extraction tool is used to deflect latch 40, maximum deflection is limited by abutment between the finger 50 and the overlapping outer stop shoulder 32. Inward movement of the latch 40 is limited by engagement of the finger 50 with the inner shoulder 34. Adequate clearance is possible between the finger 50 and the stop shoulders 32 and 34, and the surface of the groove 36 so that these features can be molded by opposed mold sections that move along the axis of the latch 40. The end of the finger 50 is also positioned so that lateral deflection of the latch 40 is prevented by engagement of the finger 40 with the interior wall face forming the groove 36. Therefore the latch 40 will remain aligned with the terminal 60 during insertion and during latch deflection. One modification to the preferred embodiment would entail reversing the side on which the finger 50 and outer stop 32 are located from that shown in FIGS. 1 and 2. The finger 50 on each latch and the outer stop shoulder 32 would then trail as the connector 10 is inserted into the shield cavity 76. This modification would reduce any damage to a latch 40 that remained in its deflected state, because the corresponding terminal 70 was not fully inserted. The finger would engaged the interior wall 30 in the groove 36 when the latch ridge 54 on the latch 40 abutted an adjacent protruding ridge 74 on an adjacent shield cavity wall 72. Abutment of the finger 50 with wall 30 in groove 36 would limit the lateral force that could then be applied to the latch 40 as a result of the terminal position assurance function of this invention. In the preferred embodiment, the finger 50 would indeed trail on the side of the connector 10 opposite from that shown in FIGS. 1 and 2. That results from the diametrically opposed orientation of the terminals 60 in the two connector rows. However, in an alternate embodiment using a different terminal, such reverse orientation would not be necessary. In another embodiment using a terminal of the type shown in FIG. 6, it would be possible to reverse the mutual orientation of the finger 50 and ridge 54 in two parallel cavity rows. Another alternate embodiment would be to include a small protrusion or shoulder on the trailing side wall to laterally support the latch when it is deflected. FIG. 7 shows an alternate version in which a laterally extending bump 59 is located on the latch side opposite the finger 50. This bump 59 engages an adjacent wall to prevent excess latch lean or deflection due to side loads. In some applications it would be necessary to reduce the thickness of the adjacent wall in order to mold this bump 59 and the reduction in the width of the wall could outweigh the benefit of the bump 59.

While the finger 50 and the shoulders 32, 34 prevent excessive deflection of the latch 40, stress concentrations are eliminated adjacent the latch base end 42 by the radiused surfaces 58 that extend between adjacent two latches 40 in two adjacent cavities 20. A notch 38 is molded in the top of each interior wall 30 adjacent latch base end 42 so that clearance is provided between the top of wall 30 and the exterior side wall 26 from which the latch 40 extends. Each latch base end 42 is thus connected to the exterior wall 26 and is not joined to the top portion of the adjacent interior wall 30. Even though these radiused sections 58 are formed by eliminating material at the latch base end 42, the resultant latch structure is less subject to excessive stress which can result in failure of the deflectable cantilever latch 40 at the latch base end 42.

Although the cavity and latch configuration as represented herein could be used, or adapted for use with, a large number of terminals, the preferred embodiment shown herein is intended for use with the terminal 60, shown in FIG. 6. This conventional terminal configuration includes a crimp section 64 joined to a contact section 62 with a gap between the crimp or termination section 64 and the contact section 62. The latch protrusion 48 is dimensioned to fit within this gap against the latch engagement edge 66. Details of the contact 60, such as contact springs located within contact section 62, are not shown herein, since it is only the overall shape or envelope of the contact that is significant to the latching engagement between the terminal 60 and the latch 40. The overstress protection provided by the overlapping shoulders 32 and 34 and the finger 50 can be incorporated into a latch having a latch protrusion of a different shape suitable for engagement with an alternate terminal configuration. Although this invention is especially adapted for use with a single ended cantilever beam as shown herein, the overstress limit configuration could also be used with a double ended beam that is joined to the housing at both the front and the rear ends of the latch. These and other modifications would be apparent to one of ordinary skill in the art, and this invention is defined by the following claims and is not limited to the specific configuration of the preferred, but representative embodiment depicted and described herein.

We claim:

1. An electrical connector comprising a housing with a plurality of terminals disposed in housing cavities, a molded deflectable latch extending from the housing into each cavity, the latch engaging an associated terminal positioned within the corresponding cavity and being deflectable to permit insertion of the associated terminal into the corresponding cavity, each cavity being formed by at least one interior wall, each molded latch being deflectable relative to an adjacent interior wall and having a finger protruding from the latch toward the adjacent interior wall, each interior wall having an outer shoulder projecting toward an adjacent latch and positioned relative to the finger to prevent excessive deflection of the molded latch, the finger being positioned relative to the adjacent interior wall to prevent the latch from lateral movement toward the adjacent interior wall as the latch is deflected.

2. The electrical connector of claim 1 wherein each interior wall includes an inner shoulder opposed and spaced from the outer shoulder extending from the same side wall, the finger on the latch being shiftable between the opposed inner and outer shoulders.

3. The electrical connector of claim 2 wherein the interior wall has a thickness between the opposed inner and outer shoulders that is less than the thickness of a remaining portion of the interior wall.

4. The electrical connector of claim 1 wherein each latch includes only one finger extending from only one side of each latch.

5. The electrical connector of claim 1 wherein each interior wall forms a wall in two adjacent cavities, each shoulder including only one shoulder extending into one of the two adjacent cavities partially formed by each interior wall.

6. The electrical connector of claim 5 wherein all of the shoulders extend in the same direction.

7. The electrical connector of claim 1 wherein each latch is exposed on an adjacent face of the housing with the exception of an overlap of the finger and the shoulder so that the finger and shoulder form the only means for preventing excessive deflection of the latch and overstressing of the latch.

8. The electrical connector of claim 1 wherein each latch comprises a cantilever latch extending from the housing on only one end of the latch.

9. The electrical connector of claim 1 wherein each latch includes a latch protrusion extending inwardly into the cavity relative to a remaining section of the latch, the latching protrusion comprising means for engaging an associated terminal to latch the associated terminal in its corresponding cavity, the finger extending from one side of the latch protrusion.

10. The electrical connector of claim 9 wherein the latch projection is spaced from a distal end of a cantilever latch.

11. An electrical connector comprising a housing with a plurality of terminals disposed in housing cavities; molded latches extending from the housing into the cavities, each latch including a latching protrusion engagable with an associated terminal in the corresponding cavity to secure the associated terminal therein, each latching protrusion being located between opposite ends of the corresponding cavity, each latching protrusion including a finger extending from one side of the latching protrusion; an interior wall of each cavity adjacent the finger including an overlapping shoulder, engagement of the finger with the shoulder, upon outward deflection of the corresponding latch, preventing excessive deflection of the corresponding latch.

12. The electrical connector of claim 11 wherein each molded latch comprises a cantilever beam extending from the housing.

13. The electrical connector of claim 12 wherein the molded latch comprises a cantilever latch integral with the housing at adjacent a rear end of the corresponding cavity and having a free end more closely adjacent to a front end of the corresponding cavity.

14. The electrical connector of claim 13 wherein the latching protrusion is recessed from the free end of the latch.

15. The electrical connector of claim 14 wherein a latch access opening is formed adjacent to the free end of the latch, each cavity being enclosed by and exterior wall extending from the latch access opening to a mating end of the housing.

16. An electrical connector comprising a housing with a plurality of cavities disposed within housing cavities and secured within corresponding cavities by a molded cantilever latch extending from an exterior side wall of the housing, each cavity being formed by parallel interior walls extending perpendicular to the exterior side wall, each interior wall having a notch adjacent the exterior side wall and beside a base of the molded cantilever latch where the cantilever latch is joined to the exterior side wall, a radiused section extending between each molded latch and a next adjacent latch with the notch separating the radiused section from an interior side wall located between adjacent latches joined by the radiused section to reduce stress in the molded cantilever latch when the latch is deflected relative to the exterior side wall.

17. The electrical connector of claim 16 wherein each molded latch is exposed in front of the exterior side wall.

18. An electrical connector assembly comprising at a least one electrical connector and an outer shield in which the electrical connector is positioned, the electrical connector including a housing with terminals positioned in a plurality of adjacent cavities, molded cantilever latch extending from the housing into each cavity, each cantilever latch securing a terminal within a corresponding housing, each latch being exposed and outwardly deflectable, the connector being insertable into the shield in a direction transverse to the orientation of the cantilever latches, the shield comprising terminal position assurance means abutting an molded latch held in an outwardly deflected position by an incompletely inserted terminal to prevent insertion of the connector into the shield unless all terminals are properly positioned in corresponding cavities with corresponding molded latches in an undeflected position.

19. The electrical connector assembly of claim 18 wherein the shield includes a shield wall that includes a ridge extending inwardly and positioned to abut a distal end of an undeflected latch when the connector is inserted into the shield.

20. The electrical connector assembly of claim 19 wherein each latch includes a latch ridge extending between the latching protrusion and the distal end of the latch, the latch ridge forming a pocket dimensioned to receive the ridge on the shield wall to prevent inward deflection of a deflected latch ridge engaging the ridge on the shield wall.

* * * * *